US005906170A

United States Patent [19]

Robertson

[11] Patent Number: 5,906,170

[45] Date of Patent: May 25, 1999

[54] AUTOMATICALLY LENGTH ADJUSTABLE WATER SKI TOW ROPE

[76] Inventor: G. David Robertson, 50 West Liberty, #600, Reno, Nev. 89501

[21] Appl. No.: 09/046,844

[22] Filed: Mar. 11, 1998

[51] Int. Cl.[6] ..... B63D 88/78

[52] U.S. Cl. ..... 114/254; 242/370

[58] Field of Search ..... 114/253, 254, 114/294; 242/370, 388, 397, 570, 590, 600, 615

[56] References Cited

U.S. PATENT DOCUMENTS

| | | | |
|---|---|---|---|
| 3,100,606 | 8/1963 | Nicholson | 114/254 |
| 3,418,627 | 12/1968 | Lyons | 114/294 |
| 4,960,065 | 10/1990 | Junkeris | 114/254 |

*Primary Examiner*—Jesus D. Sotelo

*Attorney, Agent, or Firm*—Skinner, Sutton & Watson; Charles L. Hartman

[57] ABSTRACT

Water skiers towed behind a boat can be towed by varying lengths of rope automatically adjusted by letting out or reeling in the rope to provide different lengths. The rope, trailable aft of the boat having a first boat-connecting end and a second terminal handle end has at least one length indicator placed on the rope between the first boat connecting end and the second terminal handle end. The rope is connected to a winching means mounted on said boat attached to the first boat-connecting end. A switching means allows an occupant of the boat to actuate the winching means as the boat moves through the water. A sensing means senses the passage of the length indicator on the rope, and provides a signal to the winching means upon sensing the length indicator. This signal stops the winching means, disposing the sensing means within ten centimeters of the length indicator, thereby providing at least two precisely predetermined lengths of rope trailable aft of the boat.

17 Claims, 2 Drawing Sheets

AUTOMATICALLY LENGTH ADJUSTABLE WATER SKI TOW ROPE

BACKGROUND OF THE INVENTION

1. Field of the Invention

This invention relates to ropes and rope handling, particularly to nautical ropes; and most particularly to water ski ropes and tow ropes.

2. State of the Art

Water skiing is a popular sport world-wide. As in most popular sports, this sport has given rise to competitive varieties of the sport. In one popular version of competition, the competitors ski with ropes that are decreased in increments to create progressively greater challenges for the skier. In the competition, the ropes used are frequently lengths of colored polypropylene braided rope tied together at specific lengths. The knots comprise loops of rope that allow the shortened rope to be secured by a rope attachment, frequently a post, located in the middle of the boat. This method allows the rope to be accurately shortened, but the shortening procedure requires that the skier be dropped and the boat stopped to do this. Then the skier must be re-towed using the now shorter rope.

It would be greatly advantageous if the rope could be shortened accurately while under way and while the skier is still being towed by the boat and standing on the ski or skis. Such a device would save time allowing for more efficiently run and less time consuming competitions. Such a device would have to accurately reposition the rope so that all competitors would be using exactly the same rope lengths to a precision of no more than one inch.

SUMMARY OF THE INVENTION

This invention allows water skiers towed behind a boat a means to let out or reel in rope to provide for different lengths of rope while being towed. The rope, trailable aft of the boat having a first boat-connecting end and a second terminal handle end has one or more length indicator or length indicators placed on the rope between the first boat connecting end and the second terminal handle end. The rope is connected to a winching means mounted on said boat attached to the first boat-connecting end. A switching means allows an occupant of the boat to actuate the winching means as the boat moves through the water. A sensing means senses the passage of the length indicator on the rope, and provides a signal to the winching means upon sensing the length indicator. This signal stops the winching means, disposing the sensing means within ten centimeters of the length indicator, thereby providing two or more precisely predetermined lengths of rope trailable aft of the boat.

One aspect of this invention is a water ski tow rope apparatus comprising:

a boat;

a rope trailable aft of the boat having a first boat-connecting end and a second terminal handle end;

at least one length indicator placed on the rope between the first boat connecting end and the second terminal handle end;

winching means mounted on said boat attached to the first boat-connecting end;

switching means allowing an occupant of the boat to actuate the winching means as the boat moves through the water; and sensing means to sense the length indicator on the rope, the sensing means providing a signal to the winching means upon sensing the length indicator, the signal stopping the winching means, disposing the sensing means within ten centimeters of the length indicator, thereby providing at least two precisely predetermined lengths of rope trailable aft of the boat.

A second aspect of this invention is a water ski tow rope comprising;

a substantially non-stretchable rope having a first end suitable for attachment to a boat and a second end having handle means; and at least one indicator of length incorporated on the rope.

DETAILED DESCRIPTION OF THE PREFERRED EMBODIMENT

Figure 1:
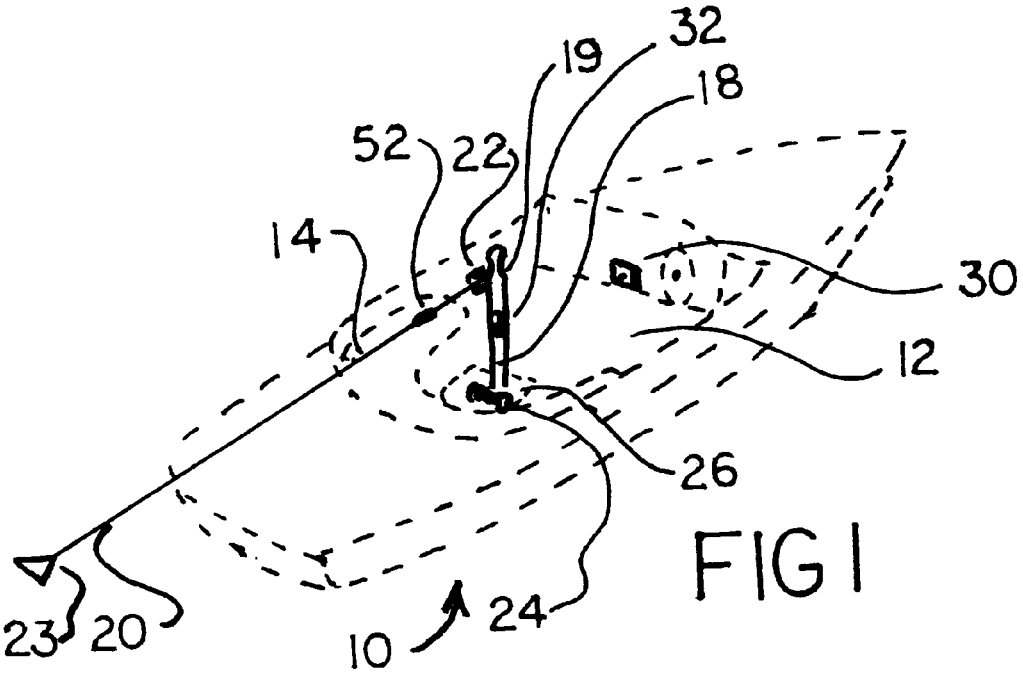
FIG. 1 shows a perspective view of a boat in phantom, showing the deck of the boat partially cut away, with the invention installed and a water skier tow rope trailing aft of the boat.

Referring to FIG. 1, a boat (the boat is shown in phantom in FIG. 1) 10 has seats for the pilot or driver 12 and the passengers 14, a motor housing 16 and a central mounting pole 18 for mounting or attaching a tow rope 20 using the first or boat connecting end 22 of the tow rope. The rope is trailable aft of the boat, and ends in a second or graspable end 23. Preferably the rope is made of polypropylene, but can be made from natural fibers such as hemp and jute or artificial fibers such as nylon, rayon, or Dacron or other fibrous synthetic material, or the rope may be made of combinations of more than one fiber. The rope can be twisted, or more preferably, braided. It has a first boat-connecting end that is connected to the central mounting pole in the boat or winching mechanism. It also has a second or handle end, that is used by the skier to grasp and be towed behind the boat. The tow rope also includes a portion of greater diameter 52 that acts as a length indicator.

The tow rope 20 is brought on board the boat 10 by retrieval means, most preferably winching means. The precise nature of the means is not critical as long as the means has a rotating means attached to the rope that can pull the rope by rotation. It is preferable to have a drum or similar object to wind the rope onto, but not essential—the rope can be pulled from the winching means by hand and placed on the deck of the boat. The winching means can be manual, but it is greatly preferred that the means be motorized for ease on the crew. As shown, a winch 24 is mounted below the deck 26 of the boat (in the Fig. the deck is shown partially sut away). The tow rope trails the boat 10 first joining the boat at the central mounting pole 18, where it is redirected by redirecting means 19 to the winch 24.

Some activating means is provided for the crew to activate the winching means. In the case of a manual means, the activating means might be a simple hand crank. But in the case of the preferred motorized means, the activating means is a switch that starts and stops the winch motor. As shown, there can be two switches, and either might be used in any particular embodiment of this invention. The first switch 30 is for the pilot or driver of the boat to operate the winch from his station. The second switch 32 is conveniently mounted so the skiing safety man may operate the winch from his vantage point of being able to view the skier. As shown, the switch is mounted on the central mounting pole, but the location is a matter of convenience. It is greatly preferred that the switch have settings that allow both reeling in of the rope and the playing out of the rope, to allow the skier the opportunity to practice on a variety of rope lengths and to allow easy resetting of a length if a skier falls.

Figure 2:
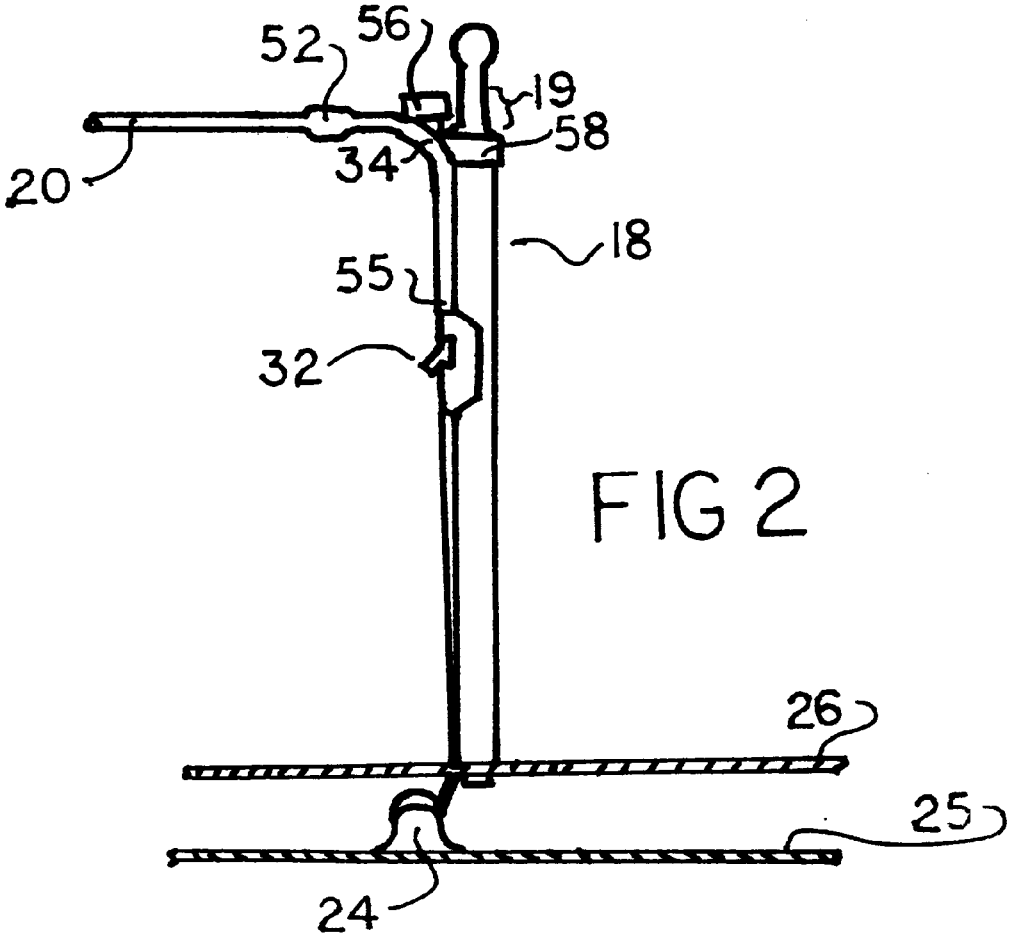
FIG. 2 shows an elevational view of the central mounting pole of the boat in FIG. 1.

Referring to FIG. 2, the central mounting pole 18 is attached to the deck 26 of the boat. The tow rope 20 trails aft of the boat (as shown in FIG. 1). It is redirected by redirecting means 19, which in this case is a smooth rope cradle 34, to allow the rope to properly trail the boat and allow it to reach a winch means 24 mounted on the deck or below the deck. Other redirecting means are of course possible, such as pulley means or any other of the numerous conventional means of redirecting nautical rope. The redirecting means on the stand redirects the rope from a winch means mounted on or below the deck to the top of the stand and there to the towed water skier.

The portion of the rope of greater diameter 52 is shown about to contact the redirecting means 19. Jaw member 56 will contact the region of larger diameter, but not the rope in general. The redirecting means is attached to the central pole by a bracket 58. The redirected rope is preferably housed in a sheath 55 to protect passengers in the boat from the moving rope.

Figure 3:
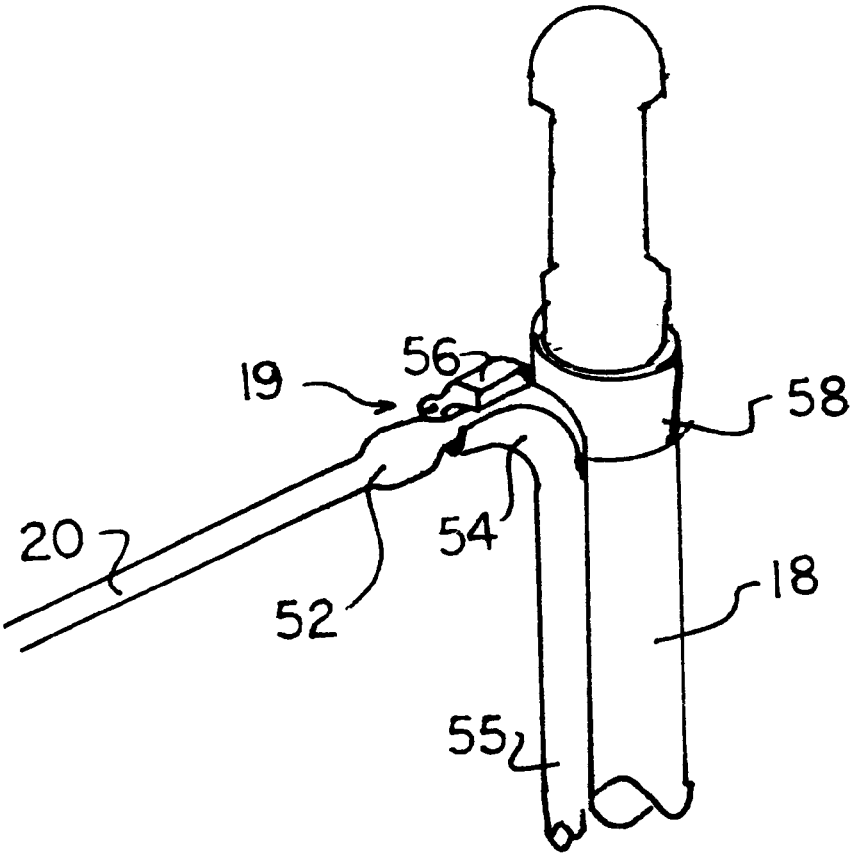
FIG. 3 shows a perspective view of the top portion of the central mounting pole shown in FIG. 2, showing the details of the jaw mechanism to start and stop the winching means.

Referring to FIG. 3, the rope retrieval system includes a sensing means to sense the length indicator on the rope. The sensing means provides a signal to the winching means upon sensing the length indicator, thereby stopping the winching means disposing the sensing means within ten centimeters, preferably five centimeters, most preferably within two centimeters of the length indicator, thereby providing at least two precisely predetermined lengths of rope trailable aft of the boat—the first without the length indicator and the second the length defined by the length indicator.

The sensing means selected depends on the indicator means chosen. For example, if the rope includes a contrasting color indicator means, the sensing means may include a means to detect variations in the amount of light reflected from the rope.

The sensing means in that case would be a photoelectric cell to measure the variation in the amount of light reflected. In another embodiment, magnetic means might be used to indicate length, and the sensing means would be a magnet, or other means to detect magnetic or metallic variations.

In the preferred embodiment, shown in FIG. 3, the length indicator is a portion of the rope 20 having a larger diameter 52 than the rest of the rope, comprising a plug of non-corrosive material interweaved with the strands of the rope. The sensing means has a first jaw member 54 and a second jaw member 56 movable relative to the first jaw member. The resulting jaw mechanism opens when the portion of larger diameter forces the first member away from the second member, the movement throwing an electric switching means of conventional design. It is preferable that the electrical switch means be automatically resettable to allow the next shortening or lengthening operation of the rope. The jaws 54 and 56 are mounted on the redirecting means and the redirecting means is mounted on the central pole, preferably removably mounted, by a mounting bracket 58.

The rope has at least one length indicator placed thereon. The length indicator indicates how much rope has been reeled in or still trails behind the boat when the indicator is at a station to read the length. The indicator is between the first end and the second end, and, typically, there may be several indicators of predetermined distances. Preferred indicator means are any means that can be placed on the rope with out increasing the diameter of the rope more than 10%, preferably more that 25%, and most preferably more than 50%, but not more than 75%, which would cause the indicator means to bind in the pulley means. Alternative indicators include magnetic means, either a magnet or a magnetically active piece, color differential means, for example black markings on an otherwise white rope, having ropes of different weaves mark the different lengths, or, most preferred, diameter modifying means.

Figure 4:
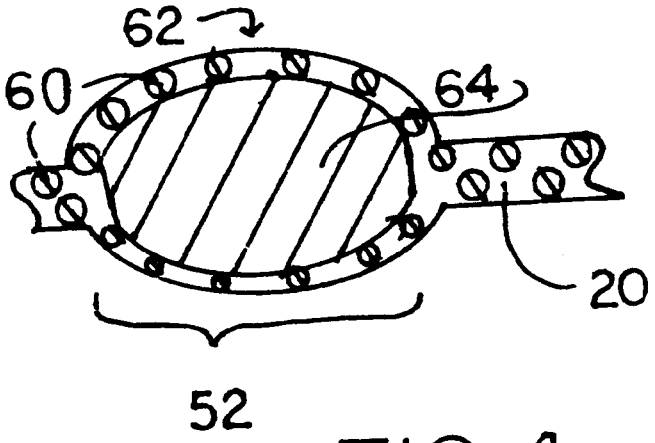
FIG. 4 shows a cut away view of the rope used in FIG. 3 to actuate the jaw mechanism.

Referring to FIG. 4, the preferred diameter modifying means is a plug or splice at the point of indication. If a plug is used, it is preferably placed inside the braiding 60 of a braided rope 62. It is greatly preferred that the plug 64 be made of non-corrosive material, such as plastic, for example, nylon, polypropylene, polyethylene, and similar plastics. An alterative that may be used to form a section of rope of greater diameter is short-splicing appropriate lengths of rope together and using the slices, loops or knots as length indicators.

The water ski tow rope of this invention will include a substantially non-stretchable rope having a first end suitable for attachment to a boat and a second end having handle means. The rope of this invention will include at least one indicator of length incorporated on the rope. It is greatly preferred that the length indicator of this rope be a diameter modifying means, such as a non-corrosive plug incorporated into the rope. It may be necessary to include a positive attachment point of the plug to the rope, such as a pocket or the like sewn into the rope.

This invention has been described with reference to specific examples and particularly preferred embodiments thereof. Various modifications, variations, and alterations will be readily apparent to those skilled in the art. The appended claims are intended to encompass all such modifications, variations, and alterations.

I claim:

1. A water ski tow rope apparatus comprising:

a boat;

a rope trailable aft of the boat having a first boat-connecting end and a second terminal handle end;

at least one contrasting color length indicator placed on the rope between the first boat connecting end and the second terminal handle end;

winching means mounted on said boat attached to the first boat-connecting end;

activating means allowing an occupant of the boat to actuate the winching means as the boat moves through the water; and photocell means to sense the contrasting color length indicator on the rope, the sensing means providing a signal to the winching means upon sensing the length indicator, the signal stopping the winching means, disposing the sensing means within ten centimeters of the length indicator, thereby providing at least two precisely predetermined lengths of rope trailable aft of the boat.

2. The water ski tow rope apparatus of claim 1 wherein the water ski tow rope apparatus further comprises more than one indicia placed on the rope at predetermined intervals.

3. The water ski tow rope apparatus of claim 1 wherein the apparatus further includes a central mounting stand to hold the rope fast to the boat.

4. The water ski tow rope apparatus of claim 3 wherein the apparatus further includes a redirecting means on the central mounting stand to redirect the rope from a winch means mounted on the boat below the central mounting stand to the top of the stand and there to the towed water skier.

5. The water ski tow rope apparatus of claim 1 further including on the tow rope contrasting color indicator means and on the sensing means a means to detect variations in the amount of light reflected from the rope.

6. The water ski tow rope apparatus of claim 5 further including a photoelectric cell to measure the variation in the amount of light reflected.

7. The water ski tow rope apparatus of claim 1 further including a magnetic means.

8. The water ski tow rope apparatus of claim 1 further including on the tow rope contrasting color indicator means and on the sensing means a means to detect variations in the amount of light reflected from the rope and a photoelectric cell to measure the variation in the amount of light reflected.

9. The water ski tow rope apparatus of claim 1 further including a two-way switching means to take in and play out rope.

10. The water ski tow rope apparatus of claim 9 wherein the indicator further comprises a plug of non-corrosive material interweaved with the strands of the rope.

11. A water ski tow rope comprising;

a substantially non-stretchable rope having a first end suitable for attachment to a boat and a second end having handle means; and at least one indicator of length incorporated on the rope.

12. The water ski tow rope of claim 11 wherein the sensing means further comprises a first jaw member and a second jaw member movable relative to the first jaw member that opens when the portion of larger diameter forces the first member away from the second member, the movement throwing an electric switch.

13. The water ski tow rope of claim 11 further including magnetic means.

14. The water ski tow rope of claim 11 wherein the length indicator is a portion of the rope having a larger diameter than the rest of the rope.

15. The water ski tow rope of claim 11 wherein the indicator further comprises a plug of non-corrosive material interweaved with the strands of the rope.

16. A water ski tow rope apparatus comprising:

a boat;

a rope trailable aft of the boat having a first boat-connecting end and a second terminal handle end; the rope having a portion of larger diameter having interwoven with the strands at least one plug of non-corrosive material placed on the rope between the first boat connecting end and the second terminal handle end;

winching means mounted on said boat attached to the first boat-connecting end;

activating means allowing an occupant of the boat to actuate the winching means as the boat moves through the water; and a means to detect the plug having a first jaw member and a second jaw member movable relative to the first jaws member that opens when the portion of larger diameter forces the first member away from the second member, the movement throwing an electric switch, to provide a signal to the winching means upon sensing the length indicator, the signal stopping the winching means, disposing the sensing means within ten centimeters of the length indicator, thereby providing at least two precisely predetermined lengths of rope trailable aft of the boat.

17. The water ski tow rope apparatus of claim 16 wherein the length indicator is a portion of the rope having a larger diameter than the rest of the rope, the indicator further comprises a plug of non-corrosive material interweaved with the strands of the rope and the sensing means further comprises a first jaw member and a second jaw member movable relative to the first jaw member that opens when the portion of larger diameter forces the first member away from the second member, the movement throwing an electric switch.

* * * * *